US006641188B2

(12) United States Patent
Arceo

(10) Patent No.: US 6,641,188 B2
(45) Date of Patent: Nov. 4, 2003

(54) ANIMAL WASTE SCOOPER

(76) Inventor: Eliseo C. Arceo, 9649 Oviedo St., San Diego, CA (US) 92129-3829

( * ) Notice: Subject to any disclaimer, the term of this patent is extended or adjusted under 35 U.S.C. 154(b) by 0 days.

(21) Appl. No.: 10/161,627

(22) Filed: Jun. 5, 2002

(65) Prior Publication Data

US 2002/0185874 A1 Dec. 12, 2002

Related U.S. Application Data

(60) Provisional application No. 60/297,251, filed on Jun. 12, 2001.

(51) Int. Cl.[7] ..... A01K 29/00; E01H 1/12

(52) U.S. Cl. ..... 294/1.4; 15/257.3; 15/257.6

(58) Field of Search ..... 294/1.3, 1.4, 1.5, 294/19.1, 19.2, 55; 15/104.8, 257.1, 257.3, 257.4, 257.6, 257.7, 257.8, 257.9; D8/4; D30/162

(56) References Cited

U.S. PATENT DOCUMENTS

| | | | | | |
|---|---|---|---|---|---|
| 3,431,008 | A | * | 3/1969 | Narita | 294/1.4 |
| 4,200,321 | A | * | 4/1980 | Warkentin | 294/1.4 |
| 4,299,419 | A | * | 11/1981 | Kalan | 294/55 |
| 4,958,871 | A | | 9/1990 | Hemans | 294/1.4 |
| 4,962,956 | A | | 10/1990 | Scripter | 294/1.4 |
| 4,986,587 | A | | 1/1991 | Lozano | 294/1.4 |
| 5,350,208 | A | | 9/1994 | Heinrichson | 294/1.4 |
| 5,380,054 | A | | 1/1995 | Galvis | 294/1.4 |
| D369,444 | S | | 4/1996 | Ubdegrove et al. | D8/4 |
| 5,513,883 | A | * | 5/1996 | Segla | 294/55 |
| 5,540,470 | A | * | 7/1996 | Lu | 294/1.4 |
| 5,820,179 | A | | 10/1998 | Tsou | 294/1.4 |
| 5,895,082 | A | | 4/1999 | Kaluzny | 294/1.4 |
| 6,030,011 | A | | 2/2000 | Layton | 294/1.4 |
| 6,062,168 | A | | 5/2000 | Host et al. | 294/1.4 |
| 6,068,311 | A | | 5/2000 | Jones | 294/1.4 |
| 6,113,166 | A | | 9/2000 | Wynn | 294/1.4 |
| 6,135,520 | A | * | 10/2000 | Miller et al. | 294/1.4 |
| 6,196,600 | B1 | | 3/2001 | Miller | 294/1.4 |
| 2002/0038957 | A1 | * | 4/2002 | Harrison | 294/1.4 |

FOREIGN PATENT DOCUMENTS

| | | |
|---|---|---|
| FR | 2 608 651 | 6/1988 |
| GB | 632621 | 11/1949 |
| WO | WO 94/09212 | 4/1994 |

* cited by examiner

*Primary Examiner*—Dean J. Kramer
*Assistant Examiner*—Paul T. Chin
(74) *Attorney, Agent, or Firm*—Richard C. Litman

(57) ABSTRACT

An animal waste scooper device comprising a hand grip on one end of a shaft having a scoop with an openable door and a removable bag at the opposite end. The hand grip operates the opening of the door for scooping up the animal waste into the bag.

3 Claims, 2 Drawing Sheets

ANIMAL WASTE SCOOPER

CROSS-REFERENCE TO RELATED APPLICATION

This application claims the benefit of U.S. Provisional Patent Application Ser. No. 60/297,251, filed Jun. 12, 2001.

BACKGROUND OF THE INVENTION

1. Field of the Invention

The present invention relates generally to an animal waste removal apparatus. More specifically, the invention is a pet litter removal device which enables the user to scoop up pet litter into an attached bag without the strain of bending over in the process.

2. Description of Related Art

The related art of interest describes various pet litter devices, but none discloses the present invention. There is a need for an economical lightweight litter pickup device in this crowded art which is simple in construction with a scooping trapdoor. The related art will be discussed in the order of perceived relevance to the present invention.

U.S. Pat. No. 6,196,600 B1 issued on Mar. 6, 2001, to Brooke D. Miller describes an animal waste scooping and disposal device comprising a plastic telescoping inner pole attached to an aluminum tray having extended forks in front and a triangular shaped waste exiting opening in the rear. The rear end of the tray can be modified with a peripheral groove for attaching a bag. The outer pole has a handle at the upper end, a tray release button and a two-prong female clip-on device to hang a portable rake. Two holding arms from the outer tube support the tray and allow the tray to automatically pivot when waste is added. The device is distinguishable for its required pivoting tray with extended fork elements.

U.S. Pat. No. 5,820,179 issued on Oct. 13, 1998, to Eric Tsou describes a refuse collection device comprising three concentric tubes telescoping each other. The handle consists of a first grip fixed to the outer tube and a second grip fixed to the intermediate tube. This structural arrangement allows the first grip and the outer tube to be movable relative to the second grip and the intermediate tube. A semicircular shaped (in cross-section) bag mount supporting a refuse collection bag is mounted at the opposite end of the tubes. The semicircular shaped cover is coupled to the outer tube for opening and closing the cover. Spherical members are received within openings in the intermediate tube and spring-biased to engage a recess formed on the outer tube to secure the open cover position. The inner tube is also spring-biased to expand to hold the collection bag. A releasing mechanism moves the inner tube relative to the intermediate tube to release the bag against the biasing spring and to release the outer tube from the open position. The device is distinguishable for its unique multiple tubular shaft structure.

U.S. Pat. No. 6,113,166 issued on Sep. 5, 2000, to David S. Wynn describes a sanitary pickup apparatus for animal feces comprising an open frame assembly vertically supporting a telescoping handle. When the handle is pushed down, a panel sweep assembly is vertically pivoted about a horizontal axis to propel the feces into the open end of a removable receptacle. The apparatus is distinguishable for its unique telescoping handle and open frame structure.

U.S. Pat. No. 5,350,208 issued on Sep. 27, 1994, to Dante C. Heinrichson describes an animal waste pickup and disposal unit comprising a pair of opposed jaws having a plastic bag removably disposed within and attached to a scissors mechanism actuated by an actuator element on the handle. The apparatus is distinguishable for it clamping jaw structure.

U.S. Pat. No. 5,380,054 issued on Jan. 10, 1995, to Misael Galvis describes a handheld device for picking up objects comprising a handgrip assembly, an elongated tubular shaft, a combination plunger and double bell-crank assembly, and clamshell buckets or gripping jaws. The device is distinguishable for its unique clamshell bucket or gripping jaw element.

U.S. Pat. No. 5,895,082 issued on Apr. 20, 1999, to William Kaluzny describes a manual pick-up device comprising a pair of pick-up blades attached to a bent shaft having a handle grip. The device is distinguishable for its pick-up bladed structure.

U.S. Pat. No. 6,030,011 issued on Feb. 29, 2000, to Charles E. Layton describes a waste collection device comprising an elongated handle having a rake device clipped to it for sweeping waste into a waste receptacle frame at the end of the handle for attaching a liner over the waste receptacle frame. The device is distinguishable for its required rake and its waste receptacle frame.

U.S. Pat. No. 6,062,168 issued on May 16, 2000, to Douglas R. Host et al. describes a sanitary refuse and animal dung collection valet device comprising a pair of tubes pivotally connected in a scissors arrangement. The user scoops the waste into a refuse collection bag which is supported at the lower end of one tube on a support frame. A pusher paddle connected to the lower end of the other tube scrapes the waste into the bag. The device is distinguishable for its scissors arrangement and requiring a pusher paddle.

U.S. Pat. No. 6,068,311 issued on May 30, 2000, to Galen K. Jones describes a sanitary pickup device comprising a pair of wire bails on one end of a tubular shaft and a handle shaped either as a bend or a pistol grip. A stationary wire bail and a movable wire bail are fixed to a yoke member. The device picks up the animal dropping by the wire bails to drop into an open bag. The device is distinguishable for its open bail structure.

U.S. Design Pat. No. 369,444 issued on Apr. 30, 1996, to Monte Ubdegrove et al. describes an animal feces retriever device comprising a clamping tray with two jaws with one lower jaw fixed to the end of a cylindrical rod and the upper jaw raised by a cable to the pistol grip handle. The device is distinguishable for its clamping jaws.

U.S. Pat. No. 4,986,587 issued on Jan. 22, 1991, to Amaro Lozano describes an animal waste collecting device comprising a two-piece post having a perpendicular handle at the top and a rod frame supporting a scoop with a normally extending edge portion with a curved upper edge. A paper or polyethylene bag is attached to the ends of the rod frame and to an L-shaped hook on the lower post. The device is distinguishable for its flat tray structure with the three-point attachment for the bag.

U.S. Pat. No. 4,958,871 issued on Sep. 25, 1990, to James W. Hemans describes a hand tool for picking up animal droppings comprising a telescopic handle with a belt clip and a spring loaded locking and release button attached to a scooping device. The scooping element comprises a pair of support arms and a centered hook with a tapered blade to form a substantially rectangular opening for a fold-lock-up sandwich bag. The hand tool is distinguishable for its limited height requiring bending over and the use of special sandwich bags.

U.S. Pat. No. 4,962,956 issued on Oct. 16, 1990, to Robert D. Scripter describes an animal waste collection device comprising a straight tubular handle having a retention slot for holding a plastic bag retained on a triangular spring wire frame. The device is pulled towards the user. The device is distinguishable for its triangular wire frame structure and the lack of a closure element.

U.K. Patent Application No. 632,621 published on Nov. 28, 1949, for Laurence Jenks describes reachers or long arm devices comprising a curved hollow arm having a head with movable jaws actuated by a chain on a squeezable hand grip. The hand grip consists of a fixed handle and a movable handle joined by a toggle lever pivoting on a pin on the movable handle and moving on a roller inside the U-shaped fixed handle. The chain is attached to the toggle lever with an adjusting nut. The device is distinguishable for its required movable jaws and toggle lever mechanism.

French Patent Application No. 2 608 651 published on Jun. 24, 1988, for Regine Lemaux et al. describes a dog feces cleaning device comprising a scraper blade attached to a rod by a pincer element. The device is distinguishable for its scraper structure.

W.I.P.O. Patent Application No. WO 94/09212 published on Apr. 28, 1994, for Luis A. Duran Moya describes a bag for collecting refuse material comprising a triangular frame for attaching a plastic bag and scraping up the animal excrement. The device is distinguishable for its triangular structure and the requirement to bend down to use the device.

None of the above inventions and patents, taken either singly or in combination, is seen to describe the instant invention as claimed.

SUMMARY OF THE INVENTION

The invention is an animal waste scooper device comprising a hand grip on one end of a shaft having a scoop with an openable door and a removable waste bag at the opposite end. The hand grip operates the closing of the door and for scooping up the animal waste for tipping into the bag. The device comprises a plastic shaft, handle and a scooping body. The handle has a stationary upper grip and a movable lower grip which lowers a right-angled lid on the scooping body via a spring and a wire shaft connection to sweep the litter into the scoop. By tipping the scoop, the litter is passed into the tied bag for easy disposal. The scooper body and lid are readily cleanable with a minimum of protruding surfaces which can trap some waste being collected.

Accordingly, it is a principal object of the invention to provide an animal waste scooper device.

It is another object of the invention to provide an animal waste scooper device having a right-angled lid.

It is a further object of the invention to provide an animal waste scooper device having a right-angled lid which forces the waste into the scooper body.

Still another object of the invention is to provide an animal waste scooper device having a waste accepting bag attached to the rear end of the scooper body.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
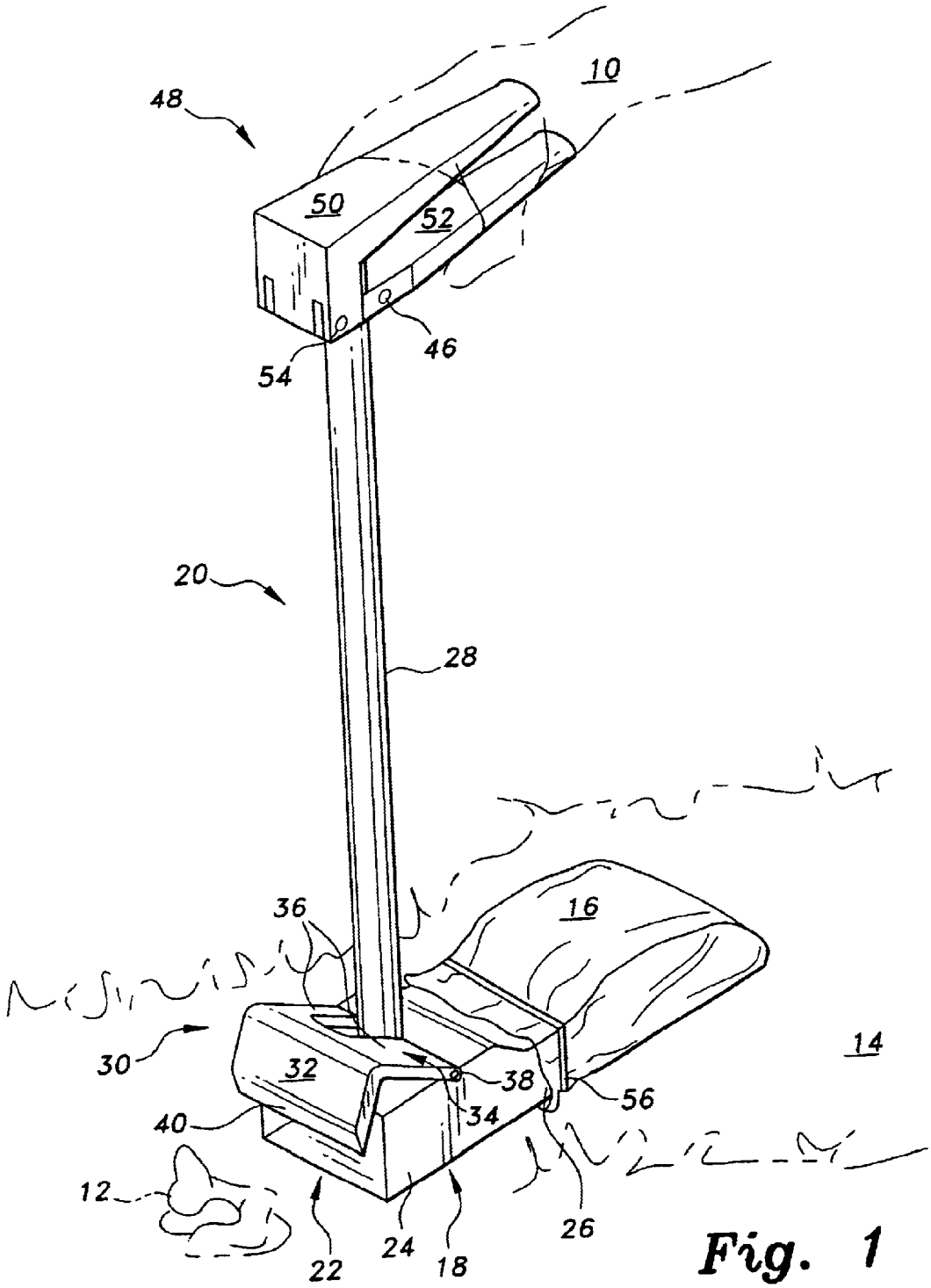
FIG. 1 is an environmental, elevational view of an animal waste scooper according to the present invention.
Figure 2:
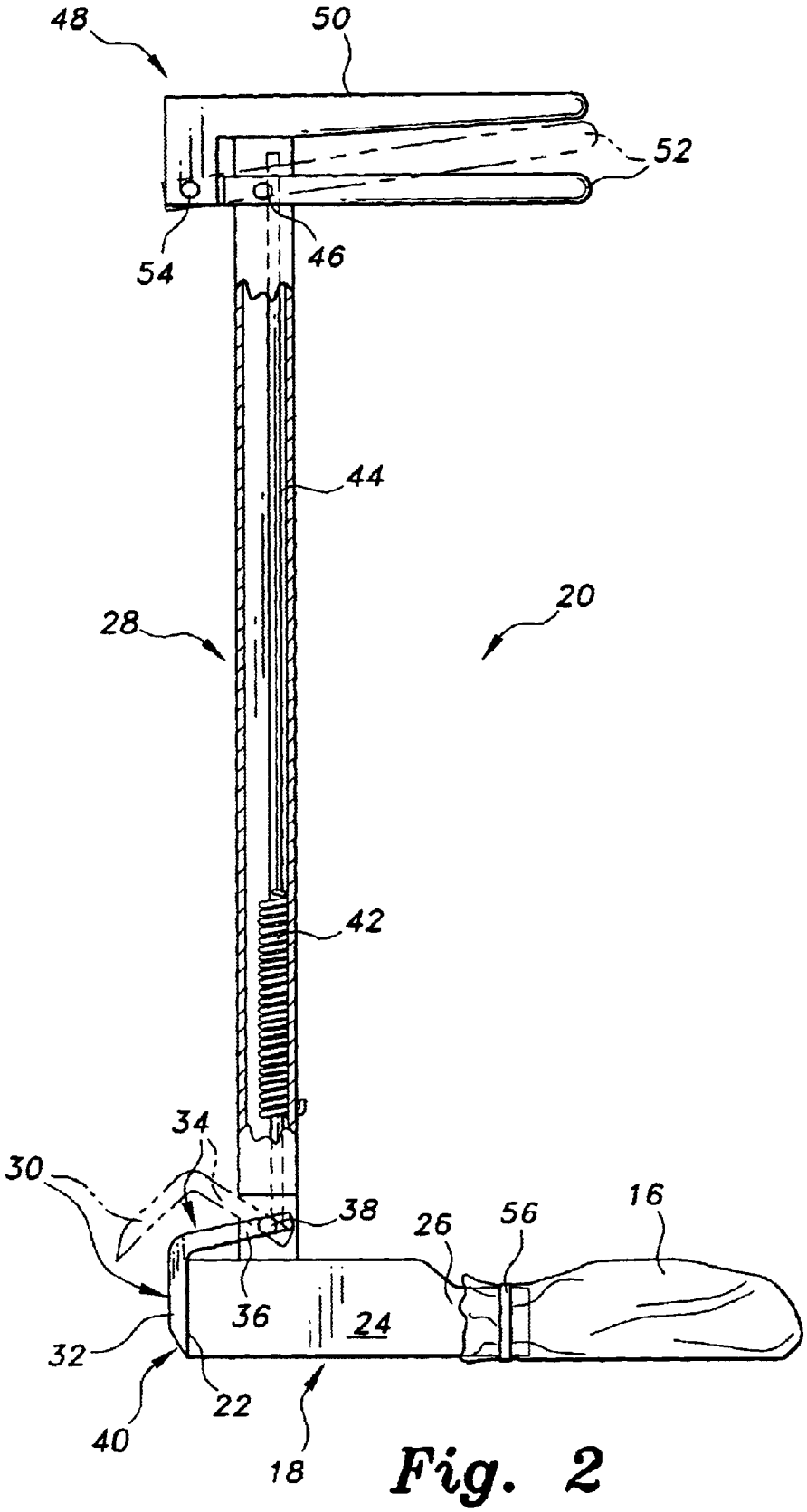
FIG. 2 is a side elevational, partially sectioned view of the device.

The present invention as shown in FIG. 1 enables a pet owner 10 (hand in shadow) to clean up the solid animal waste 12 of the pet deposited on the lawn 14 without bending over and with a minimum of effort to pass the waste into a paper or plastic collection bag 16 tied to the plastic scooper body 18 of the animal waste scooper device 20. As shown in greater detail in FIG. 2, the animal waste scooper device 20 comprises an open ended substantially rectangular four-sided scooper body 18 having a rectangular cross-section, an open receiving end section 22 having a first large cross-sectional area, a main body section 24 having the same first large cross-sectional area, and an open exit section 26 having a reduced rectangular cross-sectional area.

An upright tubular plastic shaft 28 has its bottom end attached to the scooper body 18 at its top surface proximate to the open receiving end section 22. A right-angled gate element 30 has a vertical gate portion 32 and a horizontal planar rocker arm portion 34 with its two leg portions 36 attached to a first pivot pin 38 on the bottom end of the shaft 28. The bottom edge 40 of the gate portion 32 is bevelled.

An expansion coil 42 has its bottom end attached to the first pivot pin 38 at the bottom end of the shaft 28, and its top end is attached to a metal wire shaft 44 which is attached to a second pivot pin 46 at the top end of the shaft 44.

A handle 48 has a stationary upper handle portion 50 and a pivoting lower handle portion 52 joined by a third pivot or fulcrum pin 54. The lower handle portion 52 is attached to the second pivot pin 46, whereby closing the grip on the lower handle 52 lifts the wire shaft 44 and expands the expansion coil 42 to close the gate element 30 over the open end of the scooper body 18 and to move the animal waste 12 into the main body section 24 of the device 20.

The exit section 26 has a gradually reduced height and cross-section to accommodate a collection bag 16 tied to its open exit section 26 with a string or rubber band 56. Thus, the user need only to tip the scooper body 18 to pass the animal waste 12 into the collection bag 16 which can be conveniently closed and tied up with string or rubber band 56.

As mentioned above, minimum internal cleaning is involved due to an open scooper body 18 and the gate element 30 having minimum clogging surfaces to trap some of the waste being collected.

It is to be understood that the present invention is not limited to the sole embodiment described above, but encompasses any and all embodiments within the scope of the following claims.

I claim:

1. An animal waste scooper device comprising:

an open ended substantially rectangular scooper body having a rectangular cross-section, an open receiving end section having a first large cross-sectional area, a main body section having said first large cross-sectional area, and an open exit section having a reduced rectangular cross-sectional area;

an upright tubular shaft having a bottom end attached to the scooper body at its top surface proximate to said open receiving end, and said scooper body having a gate element with a vertical gate portion and a horizontal planar rocker arm with leg portions, a first pivot pin, said leg portions attached to said first pivot pin on said bottom end of the shaft;

a wire shaft and a second pivot pin;

an expansion coil with a bottom end and a top end, said bottom end attached to said first pivot pin at the bottom end of the shaft, and its top end attached to said wire shaft which is attached to said second pivot pin at the top end of the shaft;

a third pivot pin; and a handle with a stationary upper handle portion and a pivoting lower handle portion joined by said third pivot pin, and the lower handle portion is attached to the second pivot pin;

whereby closing the grip on the lower handle expands the expansion spring to close the gate element over the open end of the scooper body.

2. The animal waste scooper device according to claim 1, wherein the exit section has a gradually reduced height.

3. The animal waste scooper device according to claim 1, wherein a collection bag with its open end is tied to the exit section with a string or rubber band.

* * * * *